US006830630B2

(12) United States Patent
Gatzke

(10) Patent No.: US 6,830,630 B2
(45) Date of Patent: Dec. 14, 2004

(54) METHOD OF CLEANING AN INTERNAL COMBUSTION ENGINE

(75) Inventor: Kenneth G. Gatzke, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/723,014

(22) Filed: Nov. 26, 2003

(65) Prior Publication Data

US 2004/0103920 A1 Jun. 3, 2004

Related U.S. Application Data

(62) Division of application No. 09/732,382, filed on Dec. 7, 2000, now abandoned.

(51) Int. Cl.[7] ..... B08B 5/04

(52) U.S. Cl. ..... 134/20; 134/8; 134/11; 134/21; 134/22.1; 134/22.11; 134/22.12; 134/22.13; 134/22.14; 134/22.18; 134/22.19; 134/23; 134/39; 134/123; 123/198 A; 123/184.21

(58) Field of Search ..... 134/20, 8, 11, 134/21; 123/22.1, 22.11, 22.12, 22.13, 22.14, 22.18, 22.19, 23.39, 123, 198 A

(56) References Cited

U.S. PATENT DOCUMENTS

| | | | |
|---|---|---|---|
| 2,626,225 | A | 1/1953 | Brandes et al. |
| 3,658,708 | A | 4/1972 | Ratto |
| 4,430,079 | A | 2/1984 | Thill et al. |
| 4,597,754 | A | 7/1986 | Thill et al. |
| 4,800,848 | A | 1/1989 | Hubbard |
| 4,807,578 | A | 2/1989 | Adams et al. |
| 4,928,859 | A | 5/1990 | Krahn et al. |
| 4,992,187 | A | 2/1991 | Adams et al. |
| 5,257,604 | A | 11/1993 | Vataru et al. |
| 5,344,493 | A | 9/1994 | Jackson |
| 5,419,352 | A | 5/1995 | Johnson |
| 5,858,942 | A | 1/1999 | Adams et al. |
| 5,955,410 | A | 9/1999 | Dingess et al. |
| 5,970,994 | A | 10/1999 | Sasaki et al. |

FOREIGN PATENT DOCUMENTS

| | | |
|---|---|---|
| EP | 0 620 270 A2 | 10/1994 |
| SU | 1202292 | 1/1997 |

OTHER PUBLICATIONS

"Solubility Parameters: Theory and Application", by John Burke, The Oakland Museum of California, Aug., 1984, Appeared in the *AIC Book of Paper Group*, Annual, vol. 3, 1984, pp. 13–58.

"The Three Dimensional Solubility Parameter—Key to Paint Component Affinities: I. Solvents, Plasticizers, Polymers, and Resings", by Charles M. Hansen, *Journal of Paint Technology*, pp. 104–117, vol. 39, No. 505, Feb., 1967.

"Tables of Solubility Parameters", Union Carbide Corporation Chemicals and Plastics Research and Development Department, Tarrytown, N.Y., May 16, 1975.

"Solubility Parameters of Organic Compounds", CRC Handbook of Chemistry & Physics, 61st Edition, 1980–1981.

*Primary Examiner*—Michael Barr
*Assistant Examiner*—Gentle E. Winter
(74) *Attorney, Agent, or Firm*—Douglas B. Little

(57) ABSTRACT

This invention provides fluid-dispensing devices attachable to an air-intake system of an internal combustion engine for introducing an engine cleaner composition into the air intake system. The invention also provides methods of cleaning internal combustion engines using the fluid-dispensing devices.

5 Claims, 5 Drawing Sheets

METHOD OF CLEANING AN INTERNAL COMBUSTION ENGINE

CROSS REFERENCE TO RELATED APPLICATIONS

This application is a divisional of U.S. application Ser. No. 09/732,382, filed Dec. 7, 2000 now abandoned.

BACKGROUND

Engine cleaner compositions are known to remove carbonaceous and lacquer deposits from air and fuel handling surfaces within internal combustion engines without the need to disassemble the engine. Throttle plates, intake manifolds, injectors, intake valves and combustion chambers all are prone to becoming coated by deposits that can affect the power, efficiency, and driveability of the vehicle. Deposits usually form, for example, when partially oxidized fuel backs up from combustion chambers when the engine is run and then shut off. Vapors and mists are deposited as liquids that may crosslink to form lacquers and then bake to form carbonaceous deposits during subsequent operation of the engine.

Prior art techniques for engine cleaning include, for example, the following.

(a) Pouring an engine cleaner composition directly into an open air throttle on the carburetor with the engine operating at high rpm. In this procedure, the cleaner is mixed with the fuel and the mixture burned during the combustion process.

(b) An injector cleaning process involving the use of a pressurized container containing an engine fuel and cleaning agent. The pressurized container is connected to a transfer apparatus which is then adapted to the fuel rail of the engine. The fuel system is disabled and the engine is operated on the fuel/cleaner mixture from the pressurized container.

(c) A vacuum disconnect technique which involves disconnecting a vacuum line from a vacuum port in communication with the air intake manifold and then connecting a rubber flex line to the vacuum port. The other end of the flex line is inserted into a container of the cleaning fluid. The engine is started and the vacuum used to evacuate the cleaning fluid from the container into the vacuum port.

(d) Do-it-yourself engine cleaning compositions that can be added directly to the fuel tank of a vehicle with the cleaning taking place during routine operation of the vehicle's engine.

In order to efficiently and effectively clean an engine of the deposits typically present, an engine cleaner composition having a wide solubility range is highly desirable. Typical solvent blends, for example, provide solubility over only a narrow range dictated by the overall composition of the blend. One way in which a wide solubility range can be provided is in the form of a microemulsion. Microemulsion engine cleaners include a water (polar) phase and an oil (non-polar) phase and, therefore, provide a composition effective to dissolve and/or remove a wide range of engine deposits. One commercially available microemulsion engine cleaner is available under the trade designation "3M FUEL SYSTEM CLEANER" from Minnesota Mining and Manufacturing Company (St. Paul, Minn.). Although microemulsions may provide the desired wide range of solubility they are typically quite expensive to manufacture. In view of the foregoing, an engine cleaner composition providing a wide range of solubility of engine deposits is highly desirable.

SUMMARY

The present invention provides engine cleaner compositions comprising:

a single phase solution comprising:

(i) a polar solvent having a Hildebrand solubility parameter of about 10 $cal^{1/2}\ cm^{-3/2}$ or greater;

(ii) a non-polar solvent, immiscible with the polar solvent, having a Hildebrand solubility parameter of about 10 $cal^{1/2}\ cm^{-3/2}$ or less; and (iii) a fugitive cosolvent having a higher evaporation rate than the polar solvent and the non-polar solvent.

In a preferred embodiment of the engine cleaner composition the polar solvent has a Hildebrand solubility parameter of about 12 $cal^{1/2}\ cm^{-3/2}$ or greater, more preferably about 14 $cal^{1/2}\ cm^{-3/2}$ or greater. Preferred polar solvents are selected from the group consisting of water, triethanolamine, ethanolamine, ethyleneglycol, diethyleneglycol, nitromethane, n-methylpyrolidone, pyridine, morpholine, and dimethylsulfoxide. In a preferred embodiment the polar solvent is present in the engine cleaner composition in an amount ranging from about 5% to about 80% by weight, more preferably about 10 to about 50% by weight.

In a preferred embodiment of the engine cleaner composition the non-polar solvent has a Hildebrand solubility parameter ranging from about 8 to 10 $cal^{1/2}\ cm^{-3/2}$. Preferred non-polar solvents are aromatic. Preferred non-polar solvents are selected from the group consisting of toluene, xylene, and aromatic petroleum distillates. A particularly preferred non-polar solvent is naphthalene depleted aromatic petroleum distillate.

The polar and non-polar solvents comprising the engine cleaner composition are immiscible with one another. As used herein the term "immiscible" means that when mixed together in approximately equal proportions the polar and non-polar solvent form two discrete phases. The phases may be identified, for example, by the formation of an interfacial meniscus between the phases. Immiscible as used herein is not meant to be absolute since immiscible polar and non-polar solvents may exhibit some degree of partial miscibility.

Engine cleaner compositions of the present invention further comprise a cosolvent which acts to solubilize the polar solvent and the non-polar solvent such that a single phase solution is formed. The cosolvent is "fugitive" meaning that it has a higher volatility than either the polar solvent or the non-polar solvent. In a preferred embodiment the cosolvent has an evaporation rate that is greater than about 1 (relative to butyl acetate), more preferably greater than about 2 (relative to butyl acetate). Preferably, the polar and non-polar solvents have an evaporation rate that is less than about 0.5 (relative to butyl acetate) more preferably less than about 0.1 (relative to butyl acetate). Preferred cosolvents are selected from the group consisting of isopropyl alcohol, ethanol, and n-propanol. In a preferred embodiment the cosolvent is present in the engine cleaner composition in a range from about 5% to about 80% by weight, more preferably 20% to about 60% by weight, and most preferably about 35% to about 65% by weight.

The polar and non-polar solvent may also be characterized according to their δP which is derived from Hansen solubility parameter components according to the equation:

$$\delta P=(\delta_p^2+\delta_h^2)^{1/2}$$

where:

$\delta_p$=Hansen polar component, and $\delta_h$=Hansen hydrogen bonding component.

According to this method preferred polar solvents have a δP of about 4.0 or greater, more preferably about 5.5 or greater, and most preferably about 7.0 or greater. Preferred non-polar solvents have a δP ranging from about 0 to about 3, more preferably ranging from about 1 to about 2.

In a preferred embodiment, the engine cleaner composition is provided in a pressure resistant container under the pressure of an aerosol propellant.

In a preferred embodiment, the engine cleaner composition further includes a non-fugitive cosolvent such as propylene glycol monomethylether.

In a preferred embodiment the engine cleaner composition further includes a detergent such as oleic acid saponified with triethanolamine.

The present invention also provides a fluid-dispensing device attachable to an air-intake system of an internal combustion engine for introducing an engine cleaner composition into the air intake system, the fluid-dispensing device comprising:

(i) a pressure-resistant container having a reservoir and a discharge orifice, the reservoir charged with an engine cleaner composition and a propellant;

(ii) a shutoff valve having an inlet and an outlet, the inlet connected with the discharge orifice of the pressure-resistant container for receiving engine cleaner composition discharged from the container; and (iii) a length of flexible tubing having an inlet end and an outlet end and a central bore extending from the inlet end to the outlet end, the inlet end of the tubing connected with the outlet of the valve for receiving engine cleaner composition discharged from the pressure-resistant container through the valve;

wherein the fluid-dispensing device provides a flow rate of engine cleaner composition at the outlet end of the length of flexible tubing ranging from about 25 to about 50 grams per minute.

In another embodiment, the present invention provides a fluid-dispensing device attachable to an air-intake system of an internal combustion engine for introducing an engine cleaner composition into the air intake system, the fluid-dispensing device comprising:

(i) a container having a reservoir and a discharge orifice, the container charged with an engine cleaner composition;

(ii) a length of flexible tubing having an inlet end and an outlet end and a central bore extending from the inlet end to the outlet end, the inlet end of the length of flexible tubing in communication with the reservoir of the container for receiving engine cleaner composition from the reservoir; and (iii) an adapter having an inlet end and an outlet end, the inlet end connected with the outlet end of the flexible tubing and the outlet end adapted to be connected to the air intake plenum for dispensing engine cleaner composition into the plenum;

wherein the fluid-dispensing device when connected to the air intake plenum of an internal combustion engine providing a vacuum ranging from about 18 to about 22 in of Hg provides a flow rate of engine cleaner composition ranging from about 25 to about 50 grams per minute.

The present invention also provides a method of cleaning an internal combustion engine having a vacuum port in communication with an air intake manifold, the method comprising the steps of:

(a) providing a fluid-dispensing device as described above;

(b) connecting the fluid-dispensing device to the vacuum port; and (c) operating the internal combustion engine to generate a vacuum at the vacuum port thereby causing the engine cleaning composition to be drawn from the reservoir through the tubing and into the air intake manifold of the internal combustion engine.

In another embodiment the present invention provides a method of cleaning an internal combustion engine having an air intake manifold, the method comprising the steps of:

(a) providing a fluid-dispensing device as described above;

(b) inserting the outlet end of the flexible tubing into the air intake manifold of the internal combustion engine;

(c) operating the internal combustion engine; and (d) opening the on-off valve to allow engine cleaner composition to flow under pressure of the aerosol propellant from the reservoir through the tubing and into the air intake manifold of the internal combustion engine.

DETAILED DESCRIPTION

Figure 1:
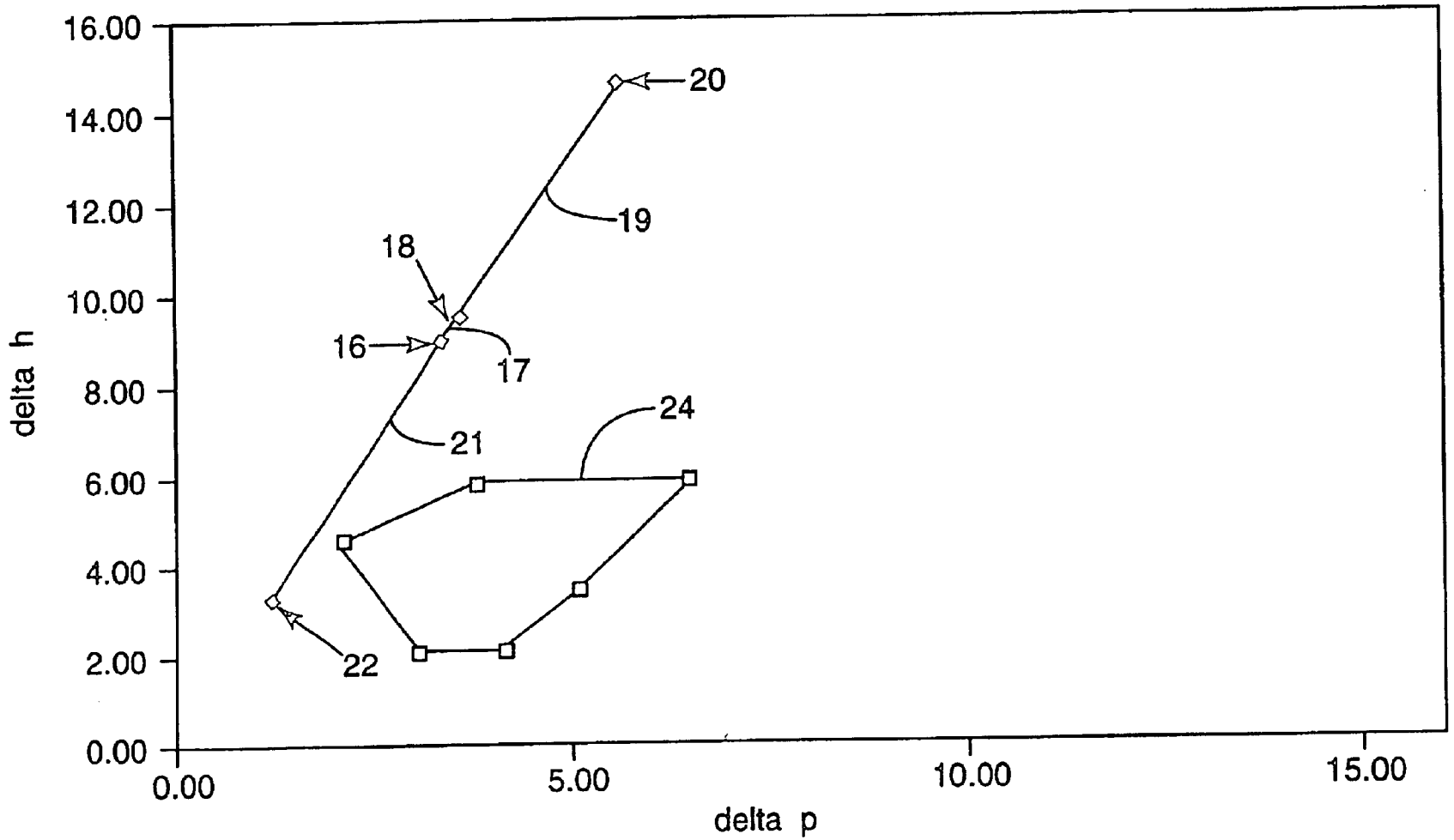
FIG. 1 is a graph of the Hansen solubility parameters for an embodiment of an engine cleaner composition.

Engine cleaning compositions of the present invention comprise at least one polar solvent, at least one non-polar solvent that is immiscible with the polar solvent, and at least one cosolvent which acts to solubilize the polar and non-polar solvents to form a single phase solution.

Polar Solvent

Engine cleaning compositions of the present invention include at least one high polarity solvent. A high polarity solvent is included in the engine cleaner composition of the present invention in order to dissolve and or disperse carbonized deposits and particulate in the engine. One method by which the polar solvents may be characterized is the Hildebrand solubility parameter. The Hildebrand solubility parameter for a solvent is equal to the square root of the cohesive energy density (c) and may be expressed according to the following equation.

$$\delta=c^{1/2}=[(\Delta H-RT)/V_m]^{1/2}$$

where:

ΔH=enthalpy of vaporization

R=gas constant

T=temperature $V_m$=molecular volume

Hildebrand solubility, parameters are typically reported in units of $cal^{1/2}\ cm^{-3/2}$ and may also be reported in SI units of $MPa^{1/2}$. Hildebrand solubility parameters for many common solvents are reported in Hansen, *Journal of Paint Technology* Vol. 39, No. 505, (February 1967); Barton, *Handbook of Solubility Parameters*, CRC Press, (1983); and in Crowley et al., *Journal of Paint Technology* Vol. 38, No. 496 (May 1966), the disclosures of which are incorporated herein by reference. Using Hildebrand solubility parameters, the value of solvent mixture can be determined by averaging the Hildebrand values of the individual solvents by volume.

Suitable polar solvents for use in the engine cleaner composition of the present invention may be characterized as having a Hildebrand solubility parameter (hereafter $H_{sp}$) of about 10 $cal^{1/2}\ cm^{-3/2}$ or greater, more preferably about 12 $cal^{1/2}$ $cm^{-3/2}$ or greater, and most preferably about 14 $cal^{1/2}$ $cm^{-3/2}$ or greater. Representative examples of high polarity solvents include water ($H_{sp}$=23.45 $cal^{1/2}$ $cm^{-3/2}$), triethanolamine ($H_{sp}$=14.87 $cal^{1/2}$ $cm^{-3/2}$), ethanolamine ($H_{sp}$=15.43 $cal^{1/2}$ $cm^{-3/2}$), ethyleneglycol ($H_{sp}$=16.28 $cal^{1/2}$ $cm^{-3/2}$), diethyleneglycol ($H_{sp}$=14.56 $cal^{1/2}$ $cm^{-3/2}$), nitromethane ($H_{sp}$=12.32 $cal^{1/2}$ $cm^{-3/2}$), n-methylpyrolidone ($H_{sp}$=11.22 $cal^{1/2}$ $cm^{-3/2}$), pyridine ($H_{sp}$=10.59 $cal^{1/2}$ $cm^{-3/2}$), morpholine ($H_{sp}$=10.56 $cal^{1/2}$ $cm^{-3/2}$ and dimethylsulfoxide ($H_{sp}$=12.95 $cal^{1/2}$ $cm^{-3/2}$). Preferred high polarity solvents include triethanolamine, n-methylpyrolidone, and water. Triethanolamine, when combined with water, is preferred, for example, due to its reduced tendency to cause damage to skin and lungs. Triethanolamine is also preferred since it increases the pH of the engine cleaner composition. High pH enhances the cleaning ability of the engine cleaner and minimizes corrosion of steel cans often used to package the engine cleaner composition.

Typically, the polar solvent is present in the engine cleaner composition in an amount ranging from about 5 to about 80% by weight, more preferably ranging from about 10% to about 50% by weight.

The polar solvent component of the engine cleaner co-position of the present invention may also be defined in terms of Hansen solubility components. The Hansen parameters divide the total Hildebrand value into three parts: (1) a dispersion force component ($\delta_d$), (2) a hydrogen bonding component ($\delta_h$), (3) and a polar component ($\delta_p$). Hansen solubility components are related to the Hildebrand solubility parameter according to the following relationship:

$$\delta_t=(\delta_d^2+\delta_p^2+\delta_h^2)^{1/2}$$

where:

$\delta_t$=total Hildebrand parameter $\delta_d$=Hansen dispersion component $\delta_p$=Hansen polar component $\delta_h$=Hansen hydrogen bonding component A summary of the Hansen solubility component method is reported in "The Three Dimensional Solubility Parameter—Key to Paint Component Affinities", Charles M. Hansen, *Journal of Paint Technology*, Vol. 39, No. 505, (February 1967), the disclosure of which is incorporated herein by reference. Hansen solubility parameters may be calculated using the method reported in "Table of Solubility Parameters" published by Union Carbide Corporation, Chemical and Plastics R&D Department, Tarrytown, N.Y. (May 16, 1975). One convenient way to measure the polarity of a solvent can be calculated from the Hansen polar component (δp) and the Hansen hydrogen bonding component ($\delta_h$) using the following formula:

$$\delta P=(\delta_p^2+\delta_h^2)^{1/2}$$

Using this formula, preferred polar solvents for use in engine cleaner compositions of the present invention have a δP of about 4.0 or greater, more preferably about 5.5 or greater, and most preferably about 7.0 or greater. Representative examples of polar solvents include water (δP=22.38), triethanolamine (δP=12.22), ethanolamine (δP=12.97), ethyleneglycol (δP=14.04), diethyleneglycol (δP=12.33), nitromethane (δP=9.34), n-methylpyrolidone (δP=6.96), pyridine (δP=5.16), morpholine (δP=5.7), and dimethylsulfoxide (δP=8.78).

Non-Polar Solvent

Engine cleaning compositions of the present invention also include at least one non-polar solvent. A non-polar solvent is included in the engine cleaner composition of the present invention in order to remove and/or dissolve engine varnish deposits (i.e., partially polymerized and/or oxidized fuel and/or oil deposits). Suitable non-polar solvents for use in engine cleaner compositions of the present invention may be characterized as having a Hildebrand solubility parameter ($H_{sp}$) of about 10 $cal^{1/2}$ $cm^{-3/2}$ or less, more preferably having a $H_{sp}$ ranging from about 8 $cal^{1/2}$ $cm^{-3/2}$ to about 10 $cal^{1/2}$ $cm^{-3/2}$. Preferred non-polar solvents are aromatic in structure. Representative examples of non-polar solvents include toluene ($H_{sp}$=8.99 $cal^{1/2}$ $cm^{-3/2}$), xylene ($H_{sp}$=8.8 $cal^{1/2}$ $cm^{-3/2}$), and aromatic petroleum distillates (i.e., polycyclic aromatics) ($H_{sp}$=8.5 to 9.5 $cal^{1/2}$ $cm^{-3/2}$). Aromatic petroleum distillates may be preferred since they may not be classified as volatile organic compounds (i.e., VOCs). Preferred aromatic petroleum distillates are napthalene depleted (i.e., containing less than about 1% by weight napthalene) since napthalene may be classified as a hazardous air pollutant (HAP). Preferred aromatic petroleum distillates are commercially available as under the trade designations "NAPTHALENE DEPLETED AROMATIC 200 FLUID" (Hsp=8.54), "AROMATIC 100", and "AROMATIC 150" ($H_{sp}$=9.04) from Exxon Mobil Chemical Co., New Milford, Conn.

The non-polar solvent component of the formulation may also be defined in terms of the polarity. Preferred non-polar solvents have δP ranging from 0 to about 3.

Typically, the non-polar solvent is present in the engine cleaner composition in an amount ranging from about 5 to about 80% by weight, more preferably ranging from about 10 to about 50% by weight.

The polar solvent and non-polar solvent in engine cleaning compositions of the present invention are immiscible with one another. As used herein the term "immiscible" means that the polar solvent and non-polar solvent will not form a single phase solution when mixed with one another. Immiscible solvents form two discrete phases upon mixing, with one phase comprising the polar solvent and one phase comprising the non-polar solvent. The term "immiscible" as used herein is not meant to mean absolute immiscibility but is meant to describe polar and non-polar solvents that are partially miscible with one another but that do not form a single phase. For example, the polar phase may partially dissolve in the non-polar phase and/or the non-polar phase may partially dissolve in the polar phase.

Cosolvent

Engine cleaning compositions of the present invention include at least one cosolvent that functions to solubilize the polar solvent with the non-polar solvent such that the polar and non-polar solvent form a single phase solution.

An important property of the cosolvent is that it is more volatile (i.e., has a higher evaporation rate) than either the polar solvent or the non-polar solvent. Preferably, the cosolvent has an evaporation rate that is greater than 1 (relative to butyl acetate), more preferably greater than 2 (relative to butyl acetate). Preferred polar and non-polar solvents have an evaporation rate that is less than about 0.5, more preferably less than 0.1 (relative to butyl acetate). The higher volatility of the cosolvent (i.e., relative to either the-polar solvent or the non-polar solvent) causes it to evaporate or flash-off under conditions of temperature and pressure typically found in the air intake manifold of an internal combustion engine. Once the cosolvent evaporates, the polar solvent and non-polar solvent spontaneously separate into two phases as they are immiscible.

Representative examples of cosolvents include isopropyl alcohol, ethanol, and n-propanol. The cosolvent is present in the engine cleaner composition in an amount effective to solubilize the non-polar solvent with the polar solvent to form a single phase solution. Preferably, the cosolvent is present in an amount effective to maintain the single phase throughout the range of storage conditions likely to be encountered during transportation and storage of the engine cleaner composition. Preferably, the cosolvent is present in an amount effective to maintain a single phase solution throughout the temperature range of about −20° F. to 120° F. (−29° C. to 49° C.). Typically the cosolvent is present in a range from about 5% to about 80% by weight, more preferably ranging from about 20% to about 60% by weight, and most preferably ranging from about 35% to about 65% by weight.

It may be desirable in some instances to add a non-fugitive cosolvent to the engine cleaner composition of the present invention. For example, the use of a non-fugitive cosolvent may be advantageous in order to limit total amount of volatile organic compounds (VOCs) in the engine cleaner composition. Suitable non-fugitive cosolvents include, for example, propylene glycol monomethylether.

Referring now to FIG. 1, a Hansen solubility parameter plot 10 of an engine cleaner composition of the present invention is shown. The Hansen solubility parameter plot 10 presents δp (delta p) plotted along the x-axis and δh (delta h) plotted along the y-axis. Reference numeral 16 designates the point on the graph representing the initial composition of the engine cleaner. Upon introduction of the engine cleaner composition into an air intake manifold of an internal combustion engine the cosolvent begins to evaporate from the engine cleaner composition. The cosolvent evaporates at a rate that is higher than the rate of evaporation of the polar solvent and the non-polar solvent. As the cosolvent evaporates, the composition of the engine cleaner changes becoming richer (i.e., on a percent weight basis) in the polar and non-polar solvents. With the change in composition of the engine cleaner composition follows a change in the solubility parameters defining the engine cleaner composition. As the cosolvent evaporates, the solubility parameters defining the engine cleaner composition shift from point 16 to point 18 following line segment 17. Break point 18 represents the point where the engine cleaner composition contains an insufficient amount of cosolvent for it to remain in a single phase solution. When the engine cleaner composition reaches break point 18 the composition spontaneously separates into a polar phase and a non-polar phase since these phases are immiscible with one another in the absence of an effective amount of the cosolvent. After separation, the polar phase is defined by the solubility parameters along line segment 19, including point 20 which represents pure (i.e., cosolvent free) polar phase. After separation, the non-polar phase is defined by the solubility parameters along line segment 21, including point 22 that represents pure (i.e., cosolvent free) non-polar phase. After separation, the polar phase moves along line segment 19 toward point 20 as the remaining cosolvent in the polar phase evaporates. After separation, the non-polar phase moves along line segment 21 toward point 22 as the remaining cosolvent in the non-polar phase evaporates. In this way, the engine cleaner composition of the present invention provides a wide range of solubility parameters (i.e., ranging from point 22 to point 20) for effective cleaning of internal combustion engines.

A preferred engine cleaner composition of the present invention will not chemically attack (i.e., dissolve) the polymeric coatings found on throttle plates of some automobiles. The Hansen solubility parameter range of susceptibility for typical throttle plate coatings is shown in FIG. 1 and includes the area inside of polygon 24 defined by the points: $\delta_p$=6.50, $\delta_h$=5.90; $\delta_p$=5.08, $\delta_h$=3.42; $\delta_p$=3.05, $\delta_h$=2.05; $\delta_p$=2.10, $\delta_h$=4.50; $\delta_p$=3.80, $\delta_h$=5.77; and $\delta_p$=4.15, $\delta_h$=2.06. Accordingly, preferred engine cleaner compositions of the present invention have Hansen solubility parameters that do not fall within polygon 24 of FIG. 1.

Optional Ingredients

Engine cleaning compositions of the present invention preferably include a detergent such as that produced by the reaction product of organic acid and an amine. One preferred detergent is formed by the saponification of oleic acid with triethanolamine. A detergent is added in order to improve the cleaning ability of the engine cleaner composition. A detergent also functions to stabilize the engine cleaner composition in a single phase. Typically, the detergent is present in the engine cleaner composition in an amount ranging from about 0.5% to about 25% by weight, more preferably ranging from about 5% to about 20% by weight. A detergent additive aids in the cleaning of carbonaceous type deposits from the engine.

Anti-corrosive agents may also be added to an engine cleaner composition of the present invention in order to prevent the composition from corroding the container, apparatus, and or vehicle parts.

Optional fragrance and/or color additives may also optionally be included in the engine cleaner composition of the present invention.

In some instances it is desirable to provide the engine cleaner composition of the present invention in a pressure-resistant container under the pressure of a propellant. Propellants suitable for use in aerosol formulations of the present invention include, for example, liquid hydrocarbon propellants such as isobutane (commercially available under the trade designation "A-31" from Technical Propellants, Inc.), propane (commercially available under the trade designation "A-110" from Technical Propellants, Inc.), or dimethyl ether (commercially available from Technical Propellants, Inc.). Preferred aerosol propellants provide a relatively constant can pressure as the engine cleaner composition is expelled. It is desirable to avoid halogenated propellants since halogenated propellants may form acid halogens, for example, HCl or HF during combustion. Typically, it is desirable to provide a can pressure in the aerosol can range from about 20 lbs/in$^2$ to about 35 lbs/in$^2$.

The engine cleaning composition of the present invention is preferably introduced into the combustion air supply path of an internal combustion engine for treatment of the engine using the method described hereinbelow and using the preferred dispensing devices described hereinbelow.

Aerosol Driven Fluid-Dispensing Device

Figure 2:
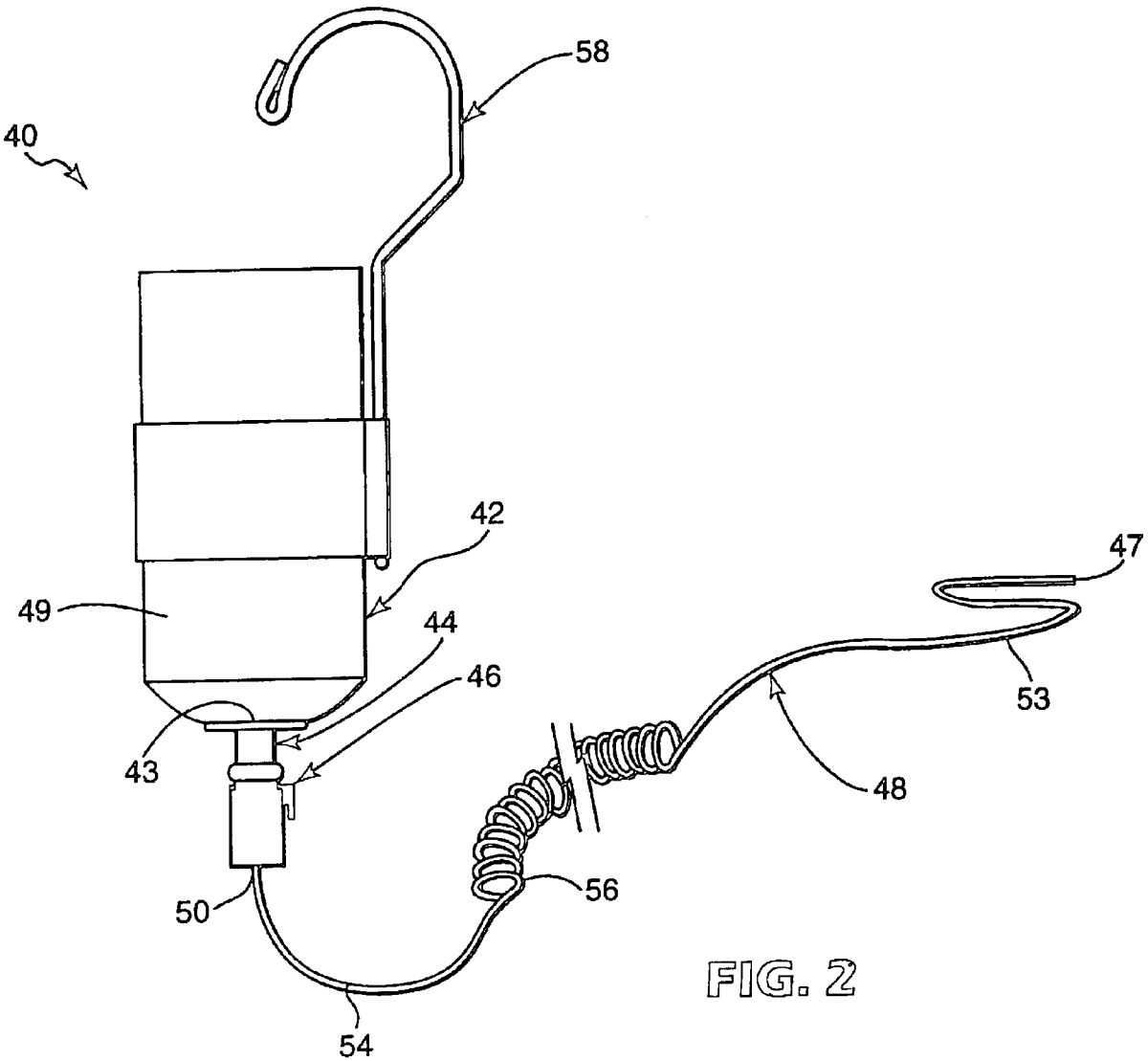
FIG. 2 is a schematic view of an embodiment of a fluid-dispensing device.

Referring now to FIG. 2, there is illustrated a fluid-dispensing device according to the present invention generally designated by reference numeral 40. The fluid-dispensing device 40 is adapted to dispense fluid at a uniform rate over a prolonged period of time (typically several minutes) which has a simple, inexpensive structure, is easy to use with little or no manual adjustment or control required to control the fluid flow rate.

Dispensing device 40 includes pressure-resistant container 42 having interior reservoir 49 that holds the engine cleaner composition of the present invention under pressure of an aerosol propellant. Pressure resistant container further includes an orifice 43 for discharging the contents of the reservoir. In the embodiment of FIG. 2 the discharge orifice 43 is connected to an on-off valve, preferably quick connect/disconnect on-off valve 44 and 46. The quick connect/disconnect on-off valve functions to open the orifice for flow of the engine cleaner composition from the reservoir when members 44 and 46 are connected to one another. Upon disconnecting 44 from 46, the flow of engine cleaner composition from orifice 43 is stopped. A preferred quick connect/disconnect on-off valve is reported in U.S. Pat. No. 4,928,859 (Krahn et al.), the disclosure of which is incorporated herein by reference. Tubing 48 has inlet end 50 and outlet end 52 and axial bore 54 extending between the inlet end 50 and outlet end 52. The inlet end 50 of small-bore tubing 48 is linked by a compression fitting with assembly member 46.

Figure 2A:
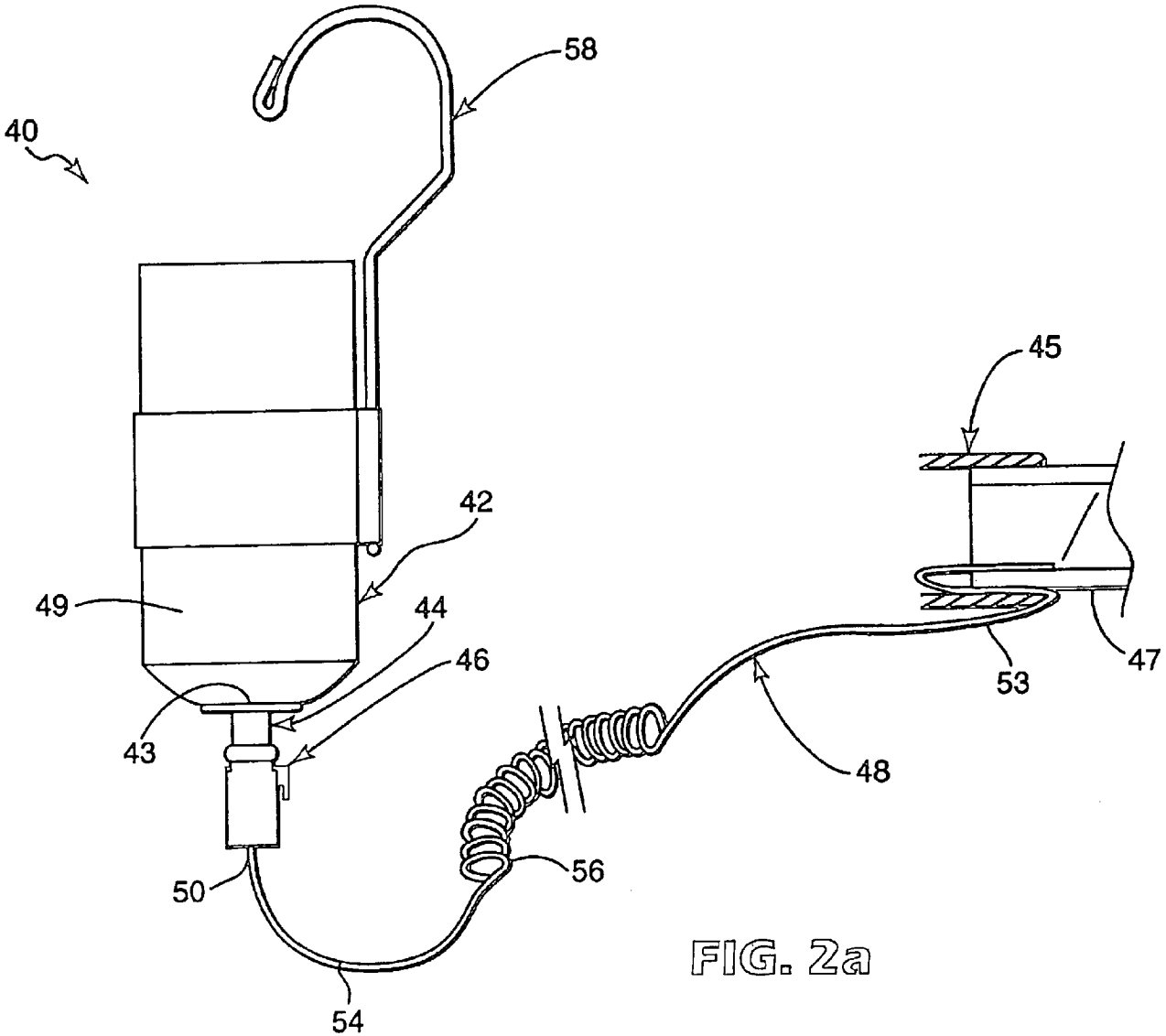
FIG. 2*a* is a schematic view of an embodiment of a fluid-dispensing device showing the device inserted into an air intake manifold of an internal combustion engine for treatment of the engine using an engine cleaner composition.

As shown in FIG. 2*a*, the section of the tubing 48 near the outlet end is preferably formed into an "S" shaped curved section 53 in order to facilitate inserting the tubing into an air intake manifold 47 on an internal combustion engine and allowing the air intake boot 45 to be connected to the air intake manifold. Tubing 48 preferably includes coiled section 56. The coiled section 56 of the tubing 48 shortens the "free" length of the tubing making it easier to handle, position, and store the fluid-dispensing device 40. Fluid-dispensing device optionally includes can hanger 58 for suspending the fluid-dispensing device 40 from inside of the hood in an upside-down arrangement. In such an arrangement the entire contents of the can may freely flow into the tubing 48 since the outlet is positioned below the interior reservoir 49 of pressure resistant container 42. Alternatively, pressure-resistant container 42 may be provided with a dip tube (not shown) to allow the contents of the container to be discharged while being positioned such that the outlet is above the interior reservoir 49 of pressure resistant container 42.

According to the method of the present invention, the rate of flow of the engine cleaner composition through the fluid-dispensing device is proportional to the fourth power of the radius (r) of the tubing and the pressure drop (P) and is-inversely proportional to the viscosity ($\mu$) of the engine cleaner composition and the length (L) of the tubing according to the equation:

$$Q=(P\pi r^4)/(8\,\mu L)$$

where:

Q=volumetric flow rate,

P=pressure drop, r=radius of tubing, $\mu$=viscosity of engine cleaner composition, and L=length of tubing.

Typically, it is desirable to introduce the engine cleaner composition into the engine at a rate of about 25 to about 50 grams per minute in order to provide optimum cleaning results and to avoid possible hydro-locking of the engine. This rate may vary depending upon the composition of the engine cleaner. To provide the desired flow rate of engine cleaner composition of the present invention, axial bore 54 of tubing 48 has a diameter ranging from about 0.050 to about 0.080 inches, more preferably ranging from about 0.060 to about 0.070 inches and has a length ranging from about 3 to about 20 feet, more preferably ranging from about 7 to 15 feet. A particularly preferred device has tubing having an axial bore of 0.068 inch (1.73 mm) and a length of 11 feet (3.35 m) and when connected to a pressure-resistant container having an internal pressure of about 28 psi will dispenses about 258 grams of engine cleaner composition in about 8.5 minutes.

Once connected to the engine intake manifold the engine is started and accelerated to an idle speed of approximately 1500 rpm using the throttle linkage. The quick connect/disconnect is then connected causing the engine cleaning composition to flow through the tubing 48 and into the air intake manifold. The engine cleaning composition is allowed to flow into the engine while the engine is in operation until the container of engine cleaner is empty, in order to provide the desired cleaning results. Typically, it will be desirable to pass about 100 to about 600 grams of engine cleaner composition through an internal combustion engine, although those of skill in the art will understand that the amount required to clean an engine will vary depending upon the condition, age, and design of the engine. When an engine is being cleaned by the engine cleaner composition of the present invention, exhaust gases from the engine should be vented to the outside in accordance with standard, safe garage-operation practice for handling internal combustion engine exhaust.

Vacuum Driven Fluid-Dispensing Device

Figure 3:
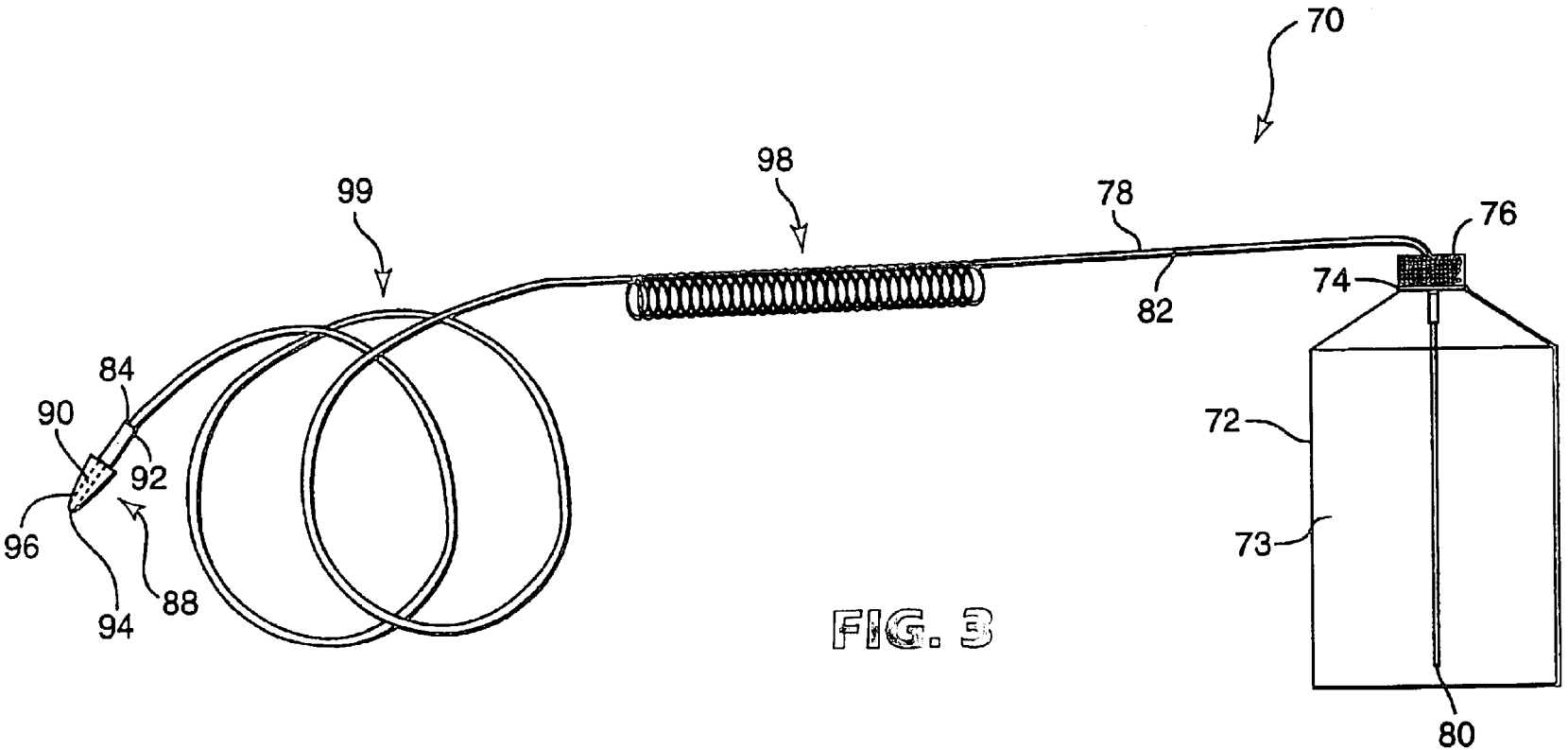
FIG. 3 is a schematic view of an embodiment of a fluid-dispensing device.
Figure 3A:
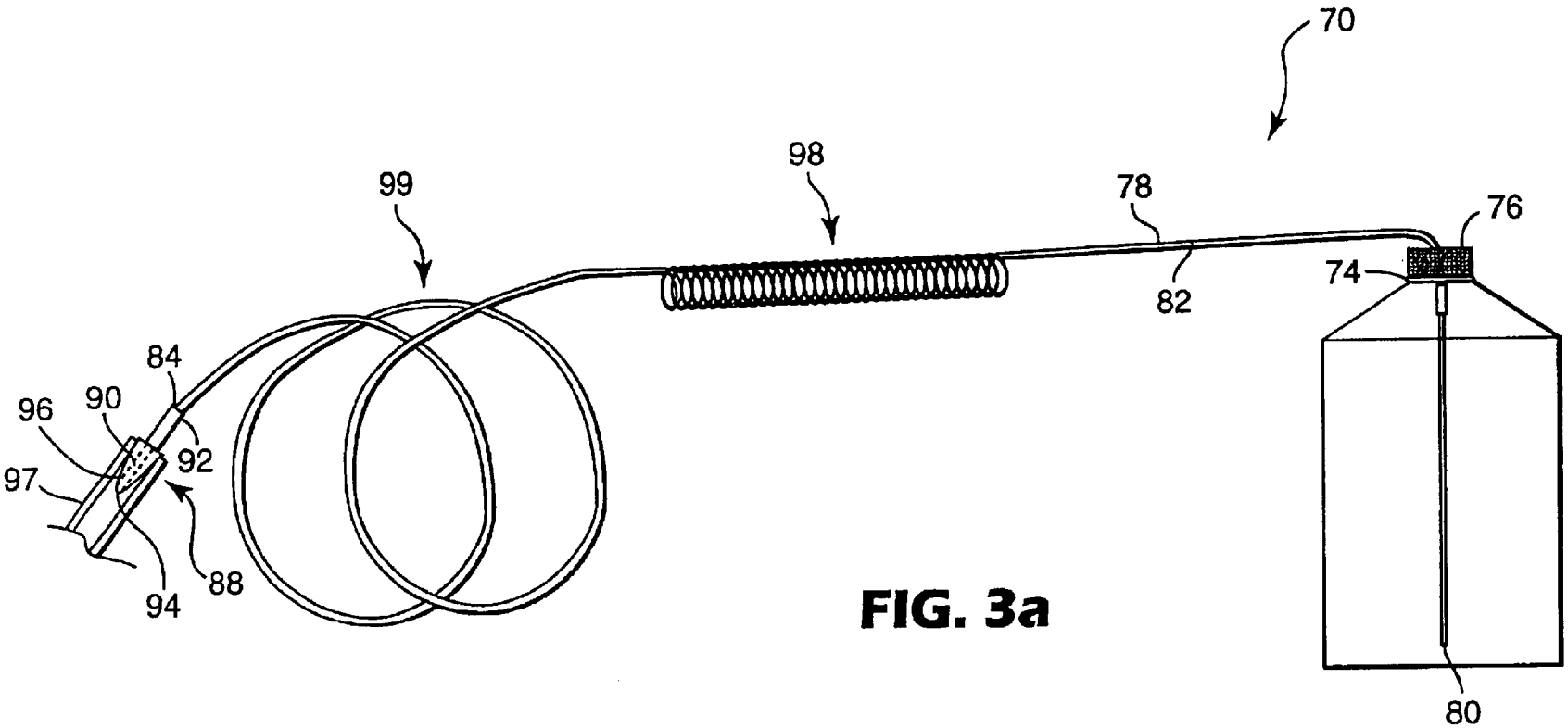
FIG. 3*a* is a schematic view of an embodiment of a fluid-dispensing device showing the device inserted into a vacuum port of an internal combustion engine for treatment of the engine using an engine cleaner composition

Another fluid-dispensing device that is capable of dispensing fluid at a uniform rate over a prolonged period of time which has a simple, inexpensive structure, is easy to use with little or no manual adjustment or control required to control the fluid flow rate is shown in FIG. 3. Fluid-dispensing device 70 includes container 72 defining reservoir 73. Container 72 has threaded opening 74 sized to receive threaded cap 76. Tubing 78 has inlet end 80 for receiving engine cleaner composition from reservoir 73 of container 72. Tubing 78 has axial bore 82 extending from inlet end 80 to outlet end 84. Preferably, axial bore 82 is circular in cross section and has a diameter ranging from about 0.050 to about 0.080 inches. Preferably, tubing 78 has a length ranging from about 3 to 20 feet, more preferably ranging from about 7 to 15 feet. In the embodiment shown in FIG. 3, outlet end 84 of tubing 78 is connected to vacuum port adapter 88. Vacuum port adapter 88 has axial bore 90 extending from inlet end 92 to outlet end 94. Inlet end 92 of vacuum port adapter 88 is sized to receive and hold tubing 78 in compression fit. Vacuum port adapter 88 includes conical surface 96 adapted to be inserted into and snugly held in a vacuum port 97 in communication with the intake manifold of an internal combustion engine (see, FIG. 3*a*). Preferably, vacuum port adapter is made of metal (e.g., brass) or plastic and has a diameter in the conical section ranging from about 0.19 to 0.5 inches. Optionally, the conical surface 96 may include barbs (not shown) in order to help prevent it from becoming dislodged from the vacuum port 97 when the dispensing device is in service. Tubing 78 preferably includes tightly coiled section 98. Tightly coiled section 98 shortens the "free" length of the tubing 86 making it easier to handle, position, and store the fluid-dispensing device 70. Tubing 78 further optionally includes loosely coiled section 99. Loosely coiled section 99 aids in preventing tightly coiled section 98 from stretching when the dispensing device 70 is attached to an internal combustion engine. Stretching of tightly coiled section 98 may be undesirably since the tension developed may cause container 72 to tip over, especially after the engine cleaner composition has been at least partially drained from reservoir 73.

One preferred engine-cleaning method for an automobile engine involves first identifying a suitable vacuum port in communication with the intake manifold for application of the engine cleaner composition. The vacuum port should preferably provide a steady source of vacuum and should preferably be located downstream (but as close as possible) to the throttle plate. Ideally, the vacuum port should not be a restricted vacuum source or a "T" connect into a vacuum source. Manifold absolute pressure (MAP) sensor, positive crankcase ventilation (PCV), and brake booster vacuum ports should also preferably be avoided. In many engines, for example, application of the engine cleaner through the PCV or brake booster vacuum port may result in distribution of the engine cleaner to less than all of the engines cylinders. Preferably, the vacuum port source should provide a vacuum of about 16 inches of Hg or greater, more preferably about 18 to 22 inches of Hg. In determining whether a proper vacuum port has been located a vacuum gauge may be useful.

After identification of a suitable vacuum port, the fluid-dispensing device containing engine cleaner composition is then connected to the vacuum port by way of the vacuum port adapter 88. It is understood to those of skill in the art that other shapes and types of fittings may also be used to connect the fluid-dispensing device to the vacuum port. Preferably, for cleaning a typical internal combustion engine of an automobile, approximately 300 grams of engine cleaner composition should be used. Once connected to a suitable engine vacuum port, the engine is started and accelerated to an idle speed of approximately 1500 RPM using the throttle linkage. The vacuum created by the engine causes the engine cleaning composition to be drawn from reservoir 73 through axial bore 82 of tubing 86 and though vacuum port adapter 88 where it enters the vacuum port in communication with the air intake manifold of the internal combustion engine. Typically, it is desirable to introduce the engine cleaner composition into the engine at a rate of about 25 to 50 grams per minute, more preferably about 30 to about 40 grams per minute in order to provide optimum cleaning results. A particularly preferred rate of introduction is about 34 grams per minute, which delivers about 290 grams in about 8.5 minutes. This rate may vary depending upon the composition of the engine cleaner.

The following non-limiting examples will further illustrate the invention. All parts, percentages, ratios, etc. in the examples are by weight unless otherwise indicated.

EXAMPLES

Example 1

Test Procedure 1

Soiled engine valves from various 5.0 liter engines manufactured by Ford Motor Company were obtained from a business engaged in engine rebuilding. The valves were visually rated according to the Society of Automotive Engineers (SAE) Cooperative Research Council (CRC) system and were given a rating of from 1 to 10, with 1 indicating fully loaded and 10 indicating clean. Valves having a rating of 6–7 were collected from the rated valves and the remaining valves were discarded from use in this Test Procedure 1. The sample valves were soaked in heptane for approximately 30 seconds and were then dried at 120° F. (49° C.) for 1 hour in an oven. The valves were then weighed and the initial weight of each valve was recorded to +/−0.0005 g. A 1-quart jar was filled with 200 grams of the engine cleaning composition to be tested. One (1) valve (prepared and weighed as described above) was placed in the jar and was allowed to soak in the engine cleaning composition for 72 hours at 120° F. (49° C.). After soaking, the valve was removed from the engine cleaner composition and was rinsed with heptane. The valve was then dried at 120° F. for 18 hours in an oven. After drying, the valve was reweighed and the final weight was recorded to +/−0.0005 g. The weight loss of the valve (i.e., $weight_{initial}-weight_{final}$) resulting from soaking in the engine cleaner composition was then calculated. The color of the engine cleaner composition was visually rated. High weight loss and dark solvent color were indicative of an effective engine cleaner composition. The results are presented in Table 1.

TABLE 1

| | Initial Weight | Final Weight | Weight Loss | Color | $\delta_d$ | $\delta_p$ | $\delta_h$ | $H_{sp}$ | $\delta P$ |
|---|---|---|---|---|---|---|---|---|---|
| SOLVENTS | | | | | | | | | |
| Deionized Water (DI) | | | | | 7.00 | 8.00 | 20.90 | 23.45 | 22.38 |
| Ethylene Glycol | | | | | 8.24 | 4.50 | 13.30 | 16.28 | 14.04 |
| Ethanolamine | 116.261 | 116.144 | 0.117 | Dark Amber | 8.35 | 8.50 | 9.80 | 15.43 | 12.97 |
| Methanol | 116.216 | 116.138 | 0.078 | Yellow | 7.38 | 6.01 | 10.90 | 14.60 | 12.45 |
| 2,2' Oxydiethanol (diethyleneglycol) | 116.957 | 116.945 | 0.012 | Light Yellow | 7.92 | 7.19 | 10.02 | 12.10 | 12.33 |
| Triethanolamine (TEA) | 117.120 | 117.220 | −0.100 | Amber | 8.47 | 2.91 | 11.87 | 14.87 | 12.22 |
| Ethyl alcohol | 117.772 | 117.751 | 0.021 | Yellow | 7.72 | 4.30 | 9.48 | 12.90 | 10.41 |
| Nitromethane | 117.355 | 117.070 | 0.285 | Light Yellow | 8.03 | 9.00 | 2.50 | 12.32 | 9.34 |
| 1-Propanol (n-Propanol) | | | | | 7.75 | 3.00 | 8.60 | 11.96 | 9.11 |
| Methyl sulfoxide (DMSO) | 116.361 | 116.247 | 0.114 | Amber | 9.52 | 6.50 | 5.90 | 12.95 | 8.78 |
| Isopropyl alcohol (IPA) | 116.026 | 115.986 | 0.040 | Yellow | 7.72 | 2.98 | 8.02 | 11.60 | 8.56 |
| Propyleneglycol methylether (PM) | | | | | 7.63 | 3.52 | 6.65 | 10.72 | 7.52 |
| Acetic anhydride | 117.339 | 117.298 | 0.041 | Dark Yellow | 7.83 | 6.70 | 3.00 | 10.73 | 7.34 |
| N-methylpyrolidone (NMP) | 117.803 | 117.608 | 0.195 | Dark Amber | 8.80 | 6.01 | 3.52 | 11.22 | 6.96 |
| N-methylpyrolidone (NMP) | 116.371 | 115.893 | 0.478 | Dark Amber | 8.80 | 6.01 | 3.52 | 11.22 | 6.96 |
| Diacetone alcohol | 116.682 | 116.639 | 0.043 | Dark Yellow | 7.72 | 4.01 | 5.28 | 9.41 | 6.63 |
| 2-Butoxyethanol (Dowanol EB) | 116.422 | 116.388 | 0.034 | Dark Yellow | 7.82 | 2.49 | 6.01 | 9.80 | 6.51 |
| 2-Butoxyethanol (Dowanol EB) | 116.524 | 116.503 | 0.021 | Dark Yellow | 7.82 | 2.49 | 6.01 | 10.17 | 6.51 |
| Methylamyl alcohol | 117.570 | 117.482 | 0.088 | Dark Yellow | 7.50 | 1.60 | 6.00 | 10.00 | 6.21 |

TABLE 1-continued

| | Initial Weight | Final Weight | Weight Loss | Color | $\delta_d$ | $\delta_p$ | $\delta_h$ | $H_{sp}$ | $\delta P$ |
|---|---|---|---|---|---|---|---|---|---|
| 2-Propanone (Acetone) | 118.676 | 118.594 | 0.082 | Dark Yellow | 7.58 | 5.08 | 3.42 | 9.73 | 6.12 |
| Dipropyleneglycol methyl ether (DPM) | 117.298 | 117.267 | 0.031 | Yellow | 7.58 | 1.96 | 5.62 | 9.64 | 5.95 |
| Tripropyleneglycol methyl ether (TPM) | 116.410 | 116.392 | 0.018 | Light Yellow | 7.38 | 1.71 | 5.62 | 9.43 | 5.87 |
| Morpholine | | | | | 8.89 | 3.50 | 4.50 | 10.56 | 5.70 |
| 1-Chloro-4-trifluoromethylbenzene (OXSOL 100) | 117.360 | 117.335 | 0.025 | Light Yellow | 6.48 | 4.63 | 2.32 | 8.29 | 5.18 |
| Pyridine | 117.437 | 117.396 | 0.041 | Amber | 9.25 | 3.70 | 3.60 | 10.59 | 5.16 |
| Methyl acetate | 117.663 | 117.425 | 0.238 | Yellow | 7.60 | 3.50 | 3.70 | 9.36 | 5.09 |
| 2-Butanone (Methylethyl ketone) (MEK) | 116.360 | 116.232 | 0.128 | Dark Yellow | 7.82 | 4.40 | 2.49 | 9.22 | 5.06 |
| Dibasic Ester 3 (DBE-3) | 117.194 | 117.174 | 0.020 | Light Yellow | 8.30 | 2.10 | 4.50 | 9.67 | 4.97 |
| Tetrahydrofuran (THF) | 117.917 | 117.847 | 0.070 | Amber | 8.21 | 2.79 | 3.91 | 9.90 | 4.80 |
| Isopropyl acetate | 114.958 | 114.931 | 0.027 | Dark Yellow | 7.30 | 2.20 | 4.00 | 8.40 | 4.57 |
| Dipropyleneglycol n-butyl ether (DPnB) | 116.982 | 116.957 | 0.025 | Yellow | 7.24 | 1.22 | 4.25 | 8.48 | 4.42 |
| Methoxypropyl acetate (PMA) | 116.149 | 116.081 | 0.068 | Yellow | 7.87 | 2.98 | 3.23 | 9.01 | 4.39 |
| Ethyl acetate | 116.260 | 116.130 | 0.130 | Amber | 7.72 | 2.60 | 3.52 | 8.80 | 4.38 |
| t-Butyl acetate (t-BA) | 116.459 | 116.423 | 0.036 | Yellow | 6.81 | 4.13 | 1.24 | 8.07 | 4.31 |
| Dimethoxymethane (Methylal) | 117.334 | 117.289 | 0.045 | Yellow | 7.40 | 4.20 | 0.90 | 8.50 | 4.30 |
| Dimethoxymethane (Methylal) | 116.540 | 116.459 | 0.081 | Light Yellow | 7.40 | 4.20 | 0.90 | 8.56 | 4.30 |
| Cyclohexanone | 116.113 | 116.032 | 0.081 | Amber | 8.70 | 3.08 | 2.49 | 9.93 | 3.96 |
| Oleic Acid | | | | | 7.37 | 2.37 | 2.77 | 8.23 | 3.65 |
| Isobutyl acetate | 116.921 | 116.873 | 0.048 | Light Yellow | 7.40 | 1.80 | 3.10 | 8.22 | 3.58 |
| Tetrachloroethylene (Perc) | 118.163 | 117.948 | 0.215 | Yellow | 9.30 | 3.20 | 1.40 | 9.93 | 3.49 |
| Tetrachloroethylene (Perc) | 117.222 | 117.161 | 0.061 | Yellow | 9.30 | 3.20 | 1.40 | 9.93 | 3.49 |
| EXXATE 1000 (E-1000) | 116.301 | 116.274 | 0.027 | Yellow | 7.30 | 2.80 | 1.50 | 7.96 | 3.18 |
| AROMATIC 150 | 117.175 | 117.152 | 0.023 | Yellow | 8.90 | 0.50 | 1.50 | 9.04 | 1.58 |
| Xylene | 116.064 | 116.047 | 0.017 | Light Yellow | 8.65 | 0.50 | 1.50 | 8.79 | 1.58 |
| AROMATIC 200 (A-200) | 116.643 | 116.623 | 0.020 | Dark Yellow | 8.40 | 0.30 | 1.50 | 8.54 | 1.53 |
| Toluene | 118.745 | 118.683 | 0.062 | Amber | 8.80 | 0.68 | 0.98 | 8.99 | 1.19 |
| 2,2-Dimethoxypropane | 118.957 | 118.910 | 0.047 | Light Yellow | 8.01 | 0.87 | 0.37 | 8.06 | 0.95 |
| d-Limonene | 117.365 | 117.315 | 0.050 | Light Yellow | 8.10 | 0.30 | 0.00 | 8.11 | 0.30 |
| SOLTROL 10 (isooctane) | 117.737 | 117.673 | 0.064 | Light Yellow | 6.86 | 0.00 | 0.00 | 6.86 | 0.00 |
| Decahydronaphthalene (DECALIN) | 117.025 | 116.982 | 0.043 | Light Yellow | 8.82 | 0.00 | 0.00 | 8.82 | 0.00 |
| Isopropane (A-31) | | | | | 6.45 | 0.00 | 0.00 | 6.45 | 0.00 |
| POLAR MIXTURES | | | | | | | | | |
| 10% TEA, 55% DI, 35% Ethanol | 117.148 | 116.950 | 0.198 | Dark Yellow | 7.40 | 6.20 | 16.00 | 18.69 | 17.16 |
| 10% TEA, 55% DI, 35% Ethanol | 117.285 | 116.978 | 0.307 | Dark Amber | 7.40 | 6.20 | 16.00 | 18.69 | 17.16 |
| 10% TEA, 45% DI, 45% Ethanol | 118.384 | 118.318 | 0.066 | Dark Amber | 7.47 | 5.83 | 14.86 | 17.62 | 15.96 |
| 10% TEA, 45% DI, 45% Ethanol | 117.530 | 117.446 | 0.084 | Amber | 7.47 | 5.83 | 14.86 | 17.62 | 15.96 |
| 10% TEA, 35% DI, 55% Ethanol | 117.071 | 116.795 | 0.276 | Amber | 7.54 | 5.46 | 13.72 | 16.58 | 14.76 |
| 10% TEA, 35% DI, 55% Ethanol | 118.200 | 117.808 | 0.392 | Dark Amber | 7.54 | 5.46 | 13.72 | 16.58 | 14.76 |
| 50% TPM, 50% DI | 117.266 | 117.237 | 0.029 | Yellow | 7.19 | 4.86 | 13.26 | 15.85 | 14.12 |
| 1% TEA, 49.5% DI, 49.5% TPM | 117.139 | 116.942 | 0.197 | Dark Amber | 7.20 | 4.84 | 13.25 | 15.83 | 14.10 |
| 1% TEA, 49.5% DI, 49.5% TPM | 117.678 | 117.676 | 0.002 | Yellow | 7.20 | 4.84 | 13.25 | 15.83 | 14.10 |
| 3% TEA, 48.5% DI, 48.5% TPM | 117.909 | 117.878 | 0.031 | Dark Yellow | 7.23 | 4.80 | 13.22 | 15.81 | 14.06 |
| 3% TEA, 48.5% DI, 48.5% TPM | 118.630 | 118.325 | 0.305 | Dark Amber | 7.23 | 4.80 | 13.22 | 15.81 | 14.06 |
| 5% TEA, 47.5% DI, 47.5% TPM | 116.600 | 116.588 | 0.012 | Yellow | 7.25 | 4.76 | 13.19 | 15.79 | 14.02 |
| 5% TEA, 47.5% DI, 47.5% TPM | 117.516 | 117.518 | −0.002 | Yellow | 7.25 | 4.76 | 13.19 | 15.79 | 14.02 |
| 45% TPM, 45% DI, 10% TEA | 117.038 | 116.864 | 0.174 | Dark Amber | 7.32 | 4.66 | 13.12 | 15.73 | 13.92 |
| 10% Oleic Acid (OA), 5% TEA, 40% TPM, 45% DI | 116.096 | 115.973 | 0.123 | Dark Amber | 7.26 | 4.67 | 12.52 | 15.21 | 13.36 |
| NON-POLAR MIXTURES | | | | | | | | | |
| 20% SOLTROL 10, 80% Acetone | 115.820 | 115.724 | 0.096 | Amber | 7.44 | 4.06 | 2.74 | 8.90 | 4.90 |
| 25% Toluene, 75% Acetone | 115.875 | 115.768 | 0.107 | Amber | 7.89 | 3.98 | 2.81 | 9.27 | 4.87 |

TABLE 1-continued

| | Initial Weight | Final Weight | Weight Loss | Color | $\delta_d$ | $\delta_p$ | $\delta_h$ | $H_{sp}$ | $\delta P$ |
|---|---|---|---|---|---|---|---|---|---|
| 50% EXXATE 1000, 50% DPM | 116.002 | 115.932 | 0.070 | Amber | 7.44 | 2.38 | 3.56 | 8.58 | 4.28 |
| 50% E-1000, 50% DPM | 114.045 | 113.993 | 0.052 | Yellow | 7.44 | 2.38 | 3.56 | 8.58 | 4.28 |
| 50% E-1000, 50% TPM | 117.023 | 116.985 | 0.038 | Yellow | 7.34 | 2.26 | 3.56 | 8.46 | 4.21 |
| 75% A-200, 25% E-1000 | 116.670 | 116.641 | 0.029 | Yellow | 6.93 | 3.80 | 1.31 | 8.01 | 4.02 |
| 50% A-200, 50% E-1000 | 116.633 | 116.602 | 0.031 | Dark Yellow | 7.06 | 3.47 | 1.37 | 7.98 | 3.73 |
| 40% E-1000, 40% TPM, 20% A-200 | 117.469 | 117.405 | 0.064 | Yellow | 7.55 | 1.86 | 3.15 | 8.39 | 3.66 |
| 25% A-200, 75% E-1000 | 118.350 | 118.328 | 0.022 | Yellow | 7.58 | 2.18 | 1.50 | 8.02 | 2.64 |
| ENGINE CLEANER COMPOSTIONS | | | | | | | | | |
| 10% OA, 5% TEA, 40% TPM, 30% DI, 15% A-200 | 117.459 | 117.207 | 0.252 | Dark Amber | 7.47 | 3.51 | 9.61 | 12.67 | 10.23 |
| 45% E-1000, 45% IPA, 10% DI | 117.375 | 117.363 | 0.012 | Yellow | 7.46 | 3.40 | 6.37 | 10.38 | 7.22 |
| 45% E-1000, 45% TPM, 10% Water (DI), 12% IPA | 116.904 | 116.566 | 0.338 | Amber | 7.35 | 2.85 | 5.59 | 9.66 | 6.27 |
| 35% E-1000, 35% TPM, 20% A-200, 10% DI, 19% IPA | 117.007 | 116.965 | 0.042 | Amber | 7.55 | 2.52 | 5.38 | 9.61 | 5.95 |
| 60% t-BA, 35% 1-PA, 5% Ethyl acetate | 117.367 | 117.353 | 0.014 | Yellow | 7.18 | 3.66 | 3.93 | 8.97 | 5.37 |
| 80% A-200, 10% TPM, 10% TEA | 116.032 | 115.882 | 0.150 | Dark Amber | 8.31 | 0.70 | 2.95 | 8.84 | 3.03 |
| OTHER | | | | | | | | | |
| BG 44K #208 (BG Products, Inc. Wichita, KS) | 117.312 | 117.264 | 0.048 | Dark Amber | | | | | |
| BG Intake Cleaner #206 (BG Products, Inc. Wichita, KS) | 116.702 | 116.374 | 0.328 | Amber | | | | | |
| GM Top Engine Cleaner (General Motors Corp.) | 118.669 | 118.053 | 0.616 | Dark Amber | | | | | |
| BG #210 Advanced Formula (BG Products, Inc. Wichita, KS) | 116.873 | 116.770 | 0.103 | Amber | | | | | |

Example 2

A videoscope analysis to test the effectiveness of a formulation of the engine cleaner composition of the present invention was conducted. The vehicle used was a 1995 CADILLAC CONCOURS with a 4.6 liter NORTHSTAR V-8 engine. First, the fuel injectors were removed to gain access to the engine and the intake valves of the engine were viewed using a videoscope in order to rate the amount of deposits on the valves. The valves were rated as a 6.5 on the CRC scale. The following engine cleaner composition was prepared by mixing the listed materials in the listed amounts.

| Material | Weight (grams) |
|---|---|
| oleic acid | 37.42 |
| isopropyl alcohol | 131.68 |
| triethanolamine | 22.45 |
| tripropyleneglycol methyl ether | 8.98 |
| AROMATIC 200-naphthalene depleted | 44.91 |
| deionized water | 53.89 |

The engine cleaner composition was administered to the engine using a fluid-dispensing device of the type shown in FIG. 3 having a tubing with length of 11 feet 6 inches and an axial bore of 0.068 inches diameter. The device was attached to a vacuum port near the throttle plate of the automobile using a conical brass adapter. The vacuum produced in the intake manifold at idle speed was used to draw the engine cleaner composition from the dispenser and into the engine. The engine was treated for nine minutes using 290 grams of engine cleaner composition. The fuel injectors were again removed to gain access to the engine and the intake valves were again viewed with the videoscope. The intake valves were rated as 8.5 on the CRC scale. An amber liquid was visible inside the manifold indicating that deposits were being dissolved into the engine cleaner composition. It was estimated that the engine cleaner composition removed about 75% of the deposits initially present on the valves.

It is to be understood that the above description is intended to be illustrative and not restrictive. Various modifications and alterations of this invention will become apparent to those skilled in the art from the foregoing description without departing from the scope and the spirit of this invention, and it should be understood that this invention is not to be unduly limited to the illustrative embodiments set forth herein.

What is claimed is:

1. A method of cleaning an internal combustion engine having an air intake manifold, the method comprising the steps of:

(a) providing a fluid-dispensing device comprising:

(i) a pressure-resistant container having a reservoir and a discharge orifice, the reservoir charged with an engine cleaner composition and a propellant;

(ii) an on-off valve having an inlet and an outlet, the inlet connected to the discharge orifice of the pressure-resistant container for receiving engine cleaner composition discharged from the container; and (iii) a length of flexible tubing having an inlet end and an outlet end and a central bore extending from the inlet end to the outlet end, the inlet end of the tubing connected with the outlet of the valve for receiving engine cleaner composition discharged from the pressure-resistant container through the valve;

(b) inserting the outlet end of the flexible tubing into the air intake manifold of the internal combustion engine;

(c) operating the internal combustion engine; and (d) opening the on-off valve to allow engine cleaner composition to flow at a rate of about 25 to about 50 grams per minute under pressure of the propellant from the reservoir through the tubing and into the air intake manifold of the internal combustion engine.

2. The method of claim 1, wherein the pressure-resistant container has a pressure ranging from about 20 $lbs/in^2$ to about 30 $lbs/in^2$.

3. The method of claim 1, wherein the tubing has a length ranging from about 1 to about 6 meters.

4. The method of claim 1, wherein the tubing has a circular central bore having a diameter ranging from about 1.3 to about 2.0 millimeters.

5. The method of claim 1, wherein the engine cleaner composition comprises:

a single phase solution comprising:

(i) a polar solvent having a Hildebrand solubility parameter of about 10 $cal^{1/2}\ cm^{-3/2}$ or greater;

(ii) a non-polar solvent, immiscible with the polar solvent, having a Hildebrand solubility parameter of about 10 $cal^{1/2}\ cm^{-3/2}$ or less; and (iii) a fugitive cosolvent having a higher evaporation rate than the polar solvent and the non-polar solvent.

* * * * *